US005431400A

United States Patent [19]

Metz

[11] Patent Number: 5,431,400

[45] Date of Patent: Jul. 11, 1995

[54] PUZZLE

[76] Inventor: James R. Metz, 1630 Makiki St., C-105, Honolulu, Hi. 96822

[21] Appl. No.: 285,923

[22] Filed: Aug. 3, 1994

[51] Int. Cl.[6] ..... A63F 3/00

[52] U.S. Cl. ..... 273/157 R; 273/282.1

[58] Field of Search ..... 273/153 R, 155, 153 S, 273/157 R, 282.1, 287

[56] References Cited

U.S. PATENT DOCUMENTS

| | | | |
|---|---|---|---|
| D. 34,767 | 7/1901 | McCaleb . | |
| D. 169,482 | 5/1953 | Henke | D34/15 |
| D. 212,242 | 9/1968 | Paulus . | |
| D. 238,698 | 2/1976 | Cook | D34/15 |
| D. 252,091 | 6/1979 | Popeck | D19/59 |
| D. 252,094 | 6/1979 | Popeck | D19/59 |
| D. 272,842 | 2/1984 | Matsumoto | D21/104 |
| D. 275,301 | 8/1984 | Cloud | D21/105 |
| 2,188,480 | 1/1940 | Murray | 273/282.1 |
| 2,520,207 | 8/1950 | Graham | 273/282.1 |
| 3,863,926 | 2/1975 | White et al. | 273/282.1 |
| 3,892,409 | 7/1975 | Herbert | 273/135 |
| 3,904,994 | 9/1975 | Bates | 333/31 |
| 4,032,151 | 6/1977 | Morse | 273/282.1 |
| 4,057,253 | 11/1977 | Csoka | 273/153 R |
| 4,177,993 | 12/1979 | Crosby | 273/160 |
| 4,254,957 | 3/1981 | Kramer | 273/282.1 |
| 4,534,563 | 8/1985 | Guenther | 273/157 |
| 4,614,344 | 9/1986 | O'Connor | 273/283 |
| 4,647,049 | 3/1987 | Oretsky et al. | 273/282.1 |

*Primary Examiner*—V. Millin
*Assistant Examiner*—Steven B. Wong
*Attorney, Agent, or Firm*—Martin E. Hsia

[57] ABSTRACT

A puzzle (20) comprising an array of identical tiles (30), each of which is in the shape of an equilateral polygon and each of which is spaced parallel and spaced apart from adjacent sides of adjacent tiles to define a web of intersecting channels (40) that intesect each other at integer multiples of a web angle. A set of movable grout pieces is provided, each of which comprises at least one elongated segment equal in length to the side of the tiles and has a width approximately equal to the width of the channels (40). Preferably, the set of grout pieces consists of all possible different configurations of between one and the number of sides of the polygons of grout segments, with the segments of the multi-segment grout pieces joined only at their ends at integer multiples of the web angle.

18 Claims, 7 Drawing Sheets

PUZZLE

TECHNICAL FIELD

This invention relates to a two dimensional puzzle, and more particularly to a two dimensional puzzle with deep mathematical roots:.

BACKGROUND ART

A large number of two dimensional puzzles is known. For example, U.S. Pat. Des. Nos. 252,094 and Des. 252,091, to Popeck disclose games sets comprising a plurality of squares bearing individual designs.

U.S. Pat. Des. No. 212,242, to Paulus discloses an alphabet puzzle in which various letters of the alphabet have nesting characteristics so that they can form a rectangle when nested together.

U.S. Pat. Des. No. 238,698, to Cook discloses a puzzle in which all the pieces combine to create a square.

U.S. Pat. Des. No. 169,482, to Henke et al. discloses a display unit of interfitted toy blocks.

U.S. Pat. Des. No. 34,767, to McCaleb discloses a design for a puzzle board on which are printed squares, each of which is composed of smaller figures of angular shape and each smaller figure having a rectangular figure in or near its center, with none of the figures alike.

U.S. Pat. Des. No. 275,301, to Cloud discloses a puzzle having various pieces to form a cross.

U.S. Pat. Des. No. 272,842, to Matsumoto discloses a puzzle including various squares and rectangles.

U.S. Pat. No. 3,904,994, to Bates et al. discloses a meander line circuit with an interdigital ground plane.

U.S. Pat. No. 3,892,409, to Herbert, Jr. discloses a game employing a board divided into squares for reception of tiles, with each tile representing an element of play.

U.S. Pat. No. 4,534,563, to Guenther discloses a three dimensional puzzle having a plurality of component pieces which, when assembled, form a plurality of different right rectangular prism solution shapes.

U.S. Pat. No. 4,177,993, to Crosby et al. discloses a variable block puzzle and container containing nine blocks that must interfit in a specific way to fit into a box.

U.S. Pat. No. 4,614,344, to O'Connor discloses a game board composed of interchangeable congruent game board segments butted together randomly allowing for variation of pathways by interchanging game board segments.

Mathematical tiling problems are usually concerned with completely covering a plane surface using multiple tiles of a particular shape or shapes. Other puzzles, such as tangrams, provide a set of pieces of particular geometric shapes, with the object being to form a single geometric shape by contiguously positioning all pieces of the set.

Many of the prior art puzzles, especially the two dimensional prior art puzzles, are not sufficiently challenging for experienced puzzle players. Further, many prior art puzzles do not express significant mathematical relationships and therefore are not appealing to puzzle players with an interest in mathematics.

Accordingly, it is an object of this invention to provide a puzzle of simple conception and construction that nevertheless provides a challenging level of complexity.

It is a further object to provide such a puzzle that expresses deep mathematical relationships.

It is a further object of this invention to provide such a puzzle that can be implemented on a video display using a computer.

It is a still further object of this invention to provide such a puzzle that can be fabricated from readily available materials.

DISCLOSURE OF INVENTION

The present invention comprises an array of identical tiles within a periphery, each of the tiles being preferably in the shape of an equilateral polygon, with each of the tiles being fixed so that its sides are parallel and spaced apart from adjacent sides of adjacent tiles by a constant channel width, so that the tiles define a web of intersecting channels of that channel width and a peripheral channel of that channel width around the periphery of the array. It is not necessary that the tiles be of only one piece or have a consistent configuration on the interior, as long as the tiles define the web of channels and peripheral channel. Indeed, in the most abstract, the tiles could consist of only interspersed points defining the web of channels and peripheral channel. Accordingly, as used herein, "tiles" shall include all tiles that define the web of channels and peripheral channel, even if the tiles comprise multiple pieces or are not consistent in interior configuration, as long as the tiles define the channels. If the equilateral polygons are regular (have a single constant interior angle), then the web angle will be equal to the interior angle. For example, if the polygons are squares, then the web angle will be 90 degrees, and the channels will intersect each other at integer multiples of 90 degrees. For a further example, if the polygons are equilateral triangles, then the web angle will be 60 degrees, and the channels will intersect each other at integer multiples of 60 degrees. However, if the equilateral polygons are not regular, so that they have a plurality of interior angles, such as rhombi, then the web angles will be equal to the interior angles. Accordingly, the array of tiles is essentially the solution to the problem of tiling a plane using a plurality of identical equilateral polygons, except that the polygons are separated from each other by a constant channel width, so that a web of intersecting channels is defined by the boundaries of the tiles and a peripheral channel is defined by the periphery of the array.

A set of movable pieces, called "grout" pieces, is provided. Each of the grout pieces comprises at least one elongated grout segment having a width approximately equal to the channel width and a length approximately equal to one side of the polygon. At least one of the grout pieces comprises at least two contiguous grout segments joined only at their ends at an integer multiple of the web angle so that the grout piece is configured to fit in (be received in) a portion of the web of channels or the peripheral channel. Preferably, the grout pieces comprise all possible different configurations of between one and the number of sides of the polygons of contiguous grout segments, with the segments of the multi-segment grout pieces joined only at their ends, wherein the segments of multi-segment grout pieces are joined at integer multiples of the web angle, so that the grout pieces will each fit in a portion of the web of channels and the peripheral channel. As long as the grout pieces have a physical width, small areas at certain intersections of channels will be left uncovered, leaving voids. Pieces that are merely mirror images of each other are not considered to be different. Because all the grout pieces are different, each grout piece is unique. For example, if the polygons comprise squares, then the grout pieces preferably comprise all possible different configurations of between one and four contiguous grout segments, with the segments of multi-segment grout pieces joined only at their ends, wherein contiguous grout segments are joined at integer multiples of 90 degrees, so that the grout pieces will each fit in a portion of the web of channels and the peripheral channel. For a further example, if the polygon is an equilateral triangle, then the grout pieces preferably comprise all possible different configurations of between one and three contiguous grout segments, with the segments of multi-segment grout pieces joined only at their ends, wherein contiguous grout segments are joined at integer multiples of 60 degrees, so that the grout pieces will each fit in a portion of the web of channels and the peripheral channel. Preferably, the array comprises the minimum number of tiles that can accommodate (receive) all of the grout pieces. The present invention can be implemented either using tiles that comprise purely visual representations, preferably implemented by a computer program, or wherein the tiles and the grout pieces comprise physical tiles and physical grout pieces, with the tiles preferably comprising plastic tiles integrally formed with a plastic backing that fixes the tiles in place, with the tops of the tiles preferably beveled, and the grout pieces preferably comprising plastic. If the present invention is implemented on a computer, then the voids can be self-healing.

In contrast to other puzzles, there can be multiple solutions for a given set of tiles, depending on the set of grout pieces. This allows for adjusting the level of difficulty of the puzzle by providing different sets of grout pieces for which different numbers of solutions might be possible. Further, this puzzle uses fixed tiles and movable interstitial pieces, instead of other puzzles that use movable tiles.

(a)—"i"
(b)—"2*i*"
(c)—"3*i*"
(d)—"4*i*"
(e)—"Small C"
(f)—"Big C"
(g)—"F"
(h)—"J"
(i)—"Small L"
(j)—"Big L"
(k)—"O"
(l)—"Small T"
(m)—"Big T"
(n)—"Long T"
(o)—"Small Z"
(p)—"Big Z"
(q)—"Big Elbow"
(r)—"Small Elbow"
(s)—"Dipper"
(t)—"Chair"
(u)—"cross"
(v)—"Four"
(w)—"Two Stairs"
(x)—"Walk and Stair"

Figure 1:
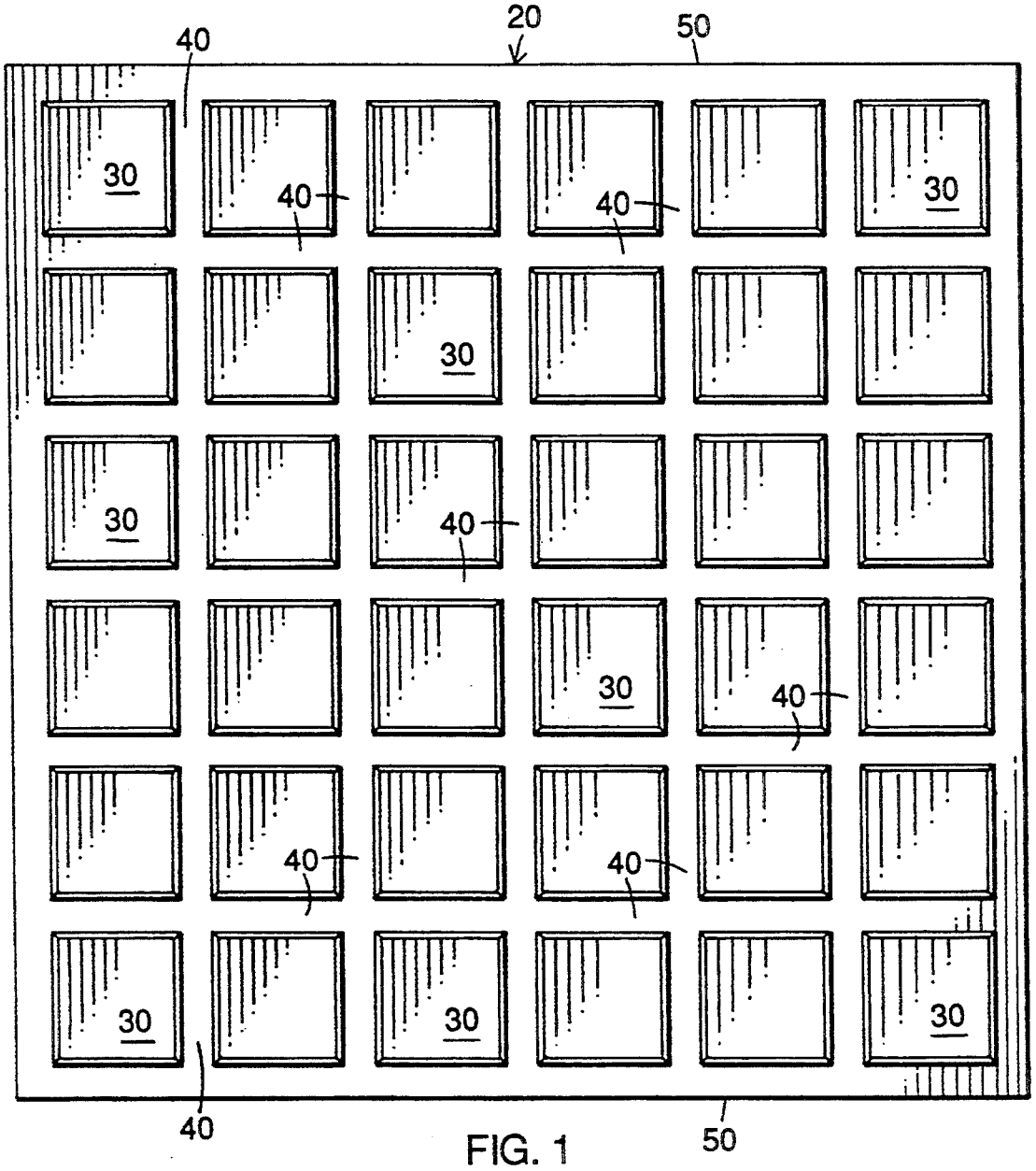
FIG. 1 is a top plan view of an array of tiles for a first preferred embodiment of the present invention in which all the tiles are squares and the array consists of thirty six tiles arranged in six rows and six columns to form a square.
Figure 3A:
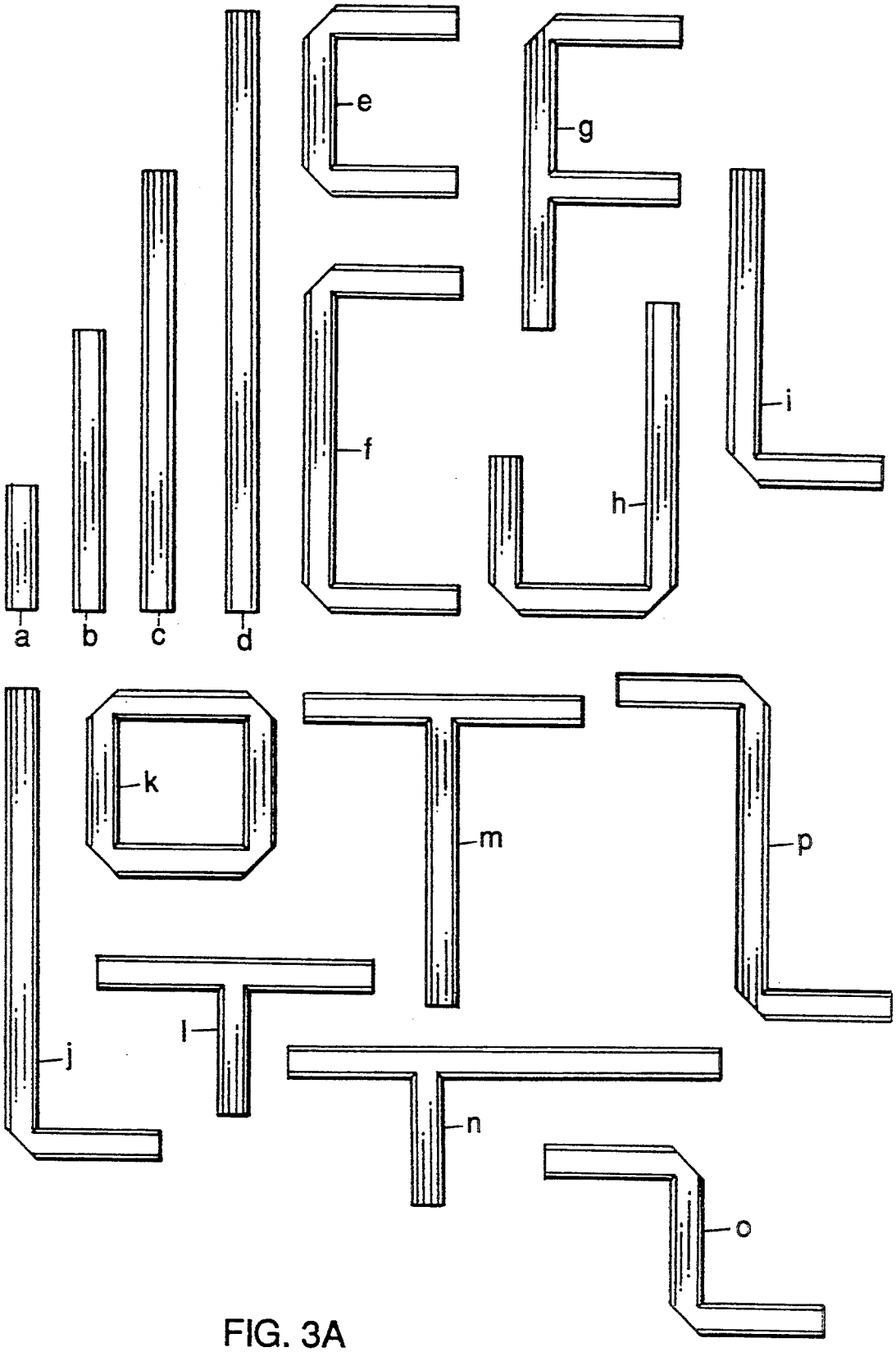
FIGS. 3A and 3B are top plan views of a preferred embodiment of grout pieces for use in connection with the array of FIG. 1, which are labeled and named as follows.
Figure 3B:
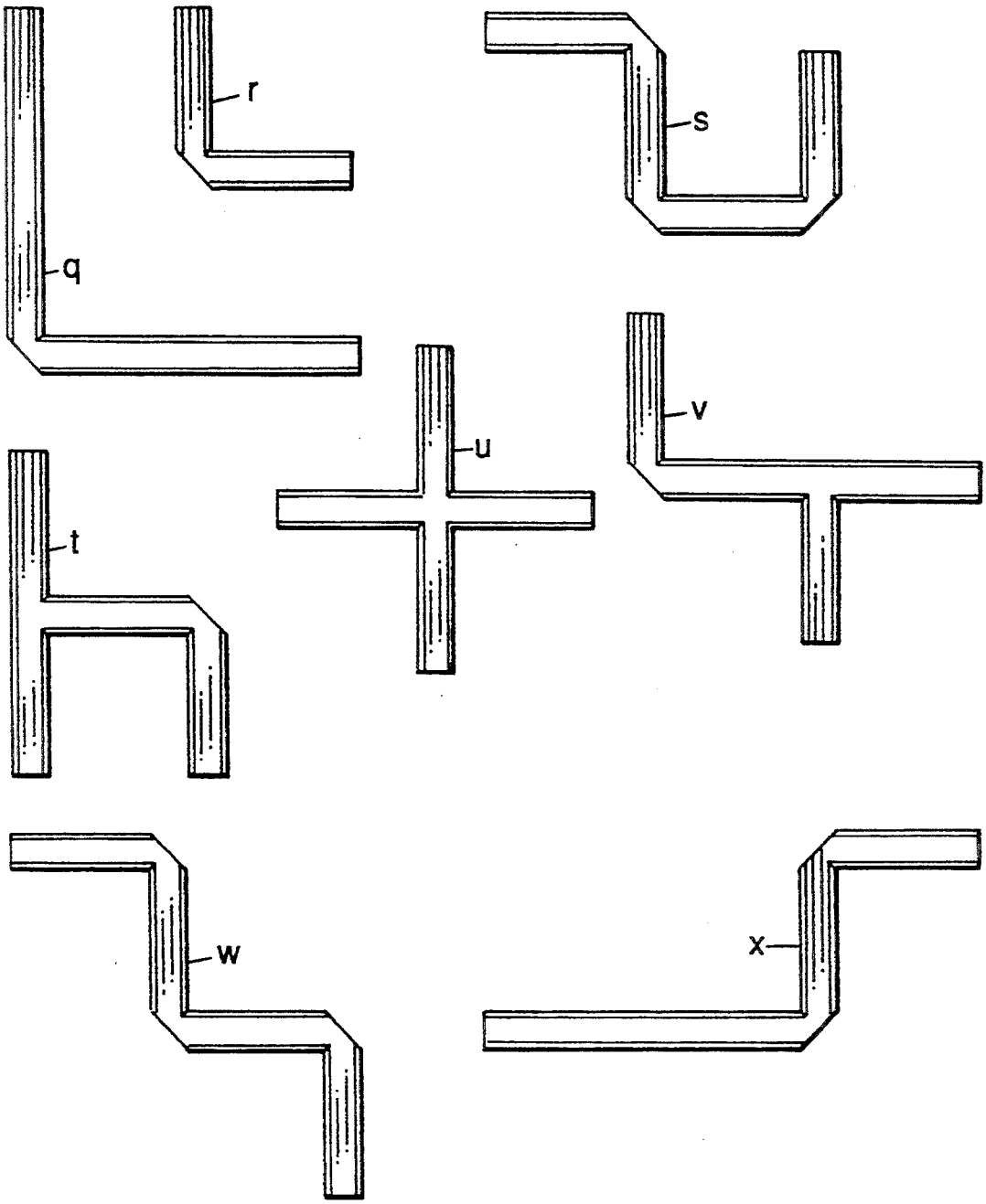
Figure 4:
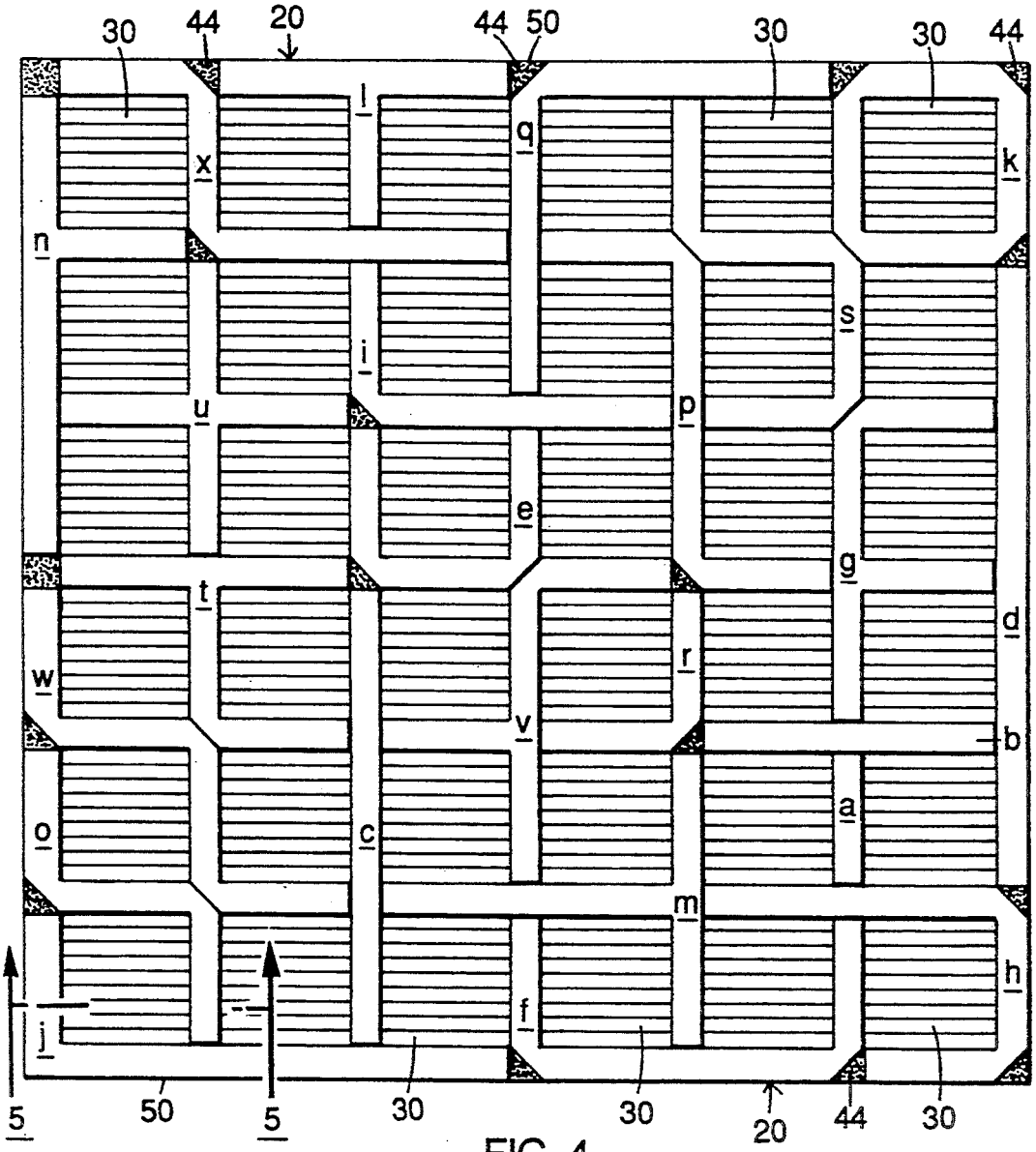

FIG. 4 is a top plan view of an alternative embodiment of an array of tiles according to FIG. 1 showing one possible solution to the puzzle in which each tile consists of a plurality of parallel adjacent elongated pieces, with all of the grout pieces of FIGS. 3A and 3B received in the web of channels and peripheral channel defined by the tiles, and the corresponding piece numbers from FIG. 3 labeled thereon.

Figure 5:
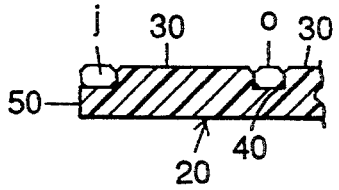

FIG. 5 is a front elevational cut away view along the line 5—5 of FIG. 4.

Figure 6:
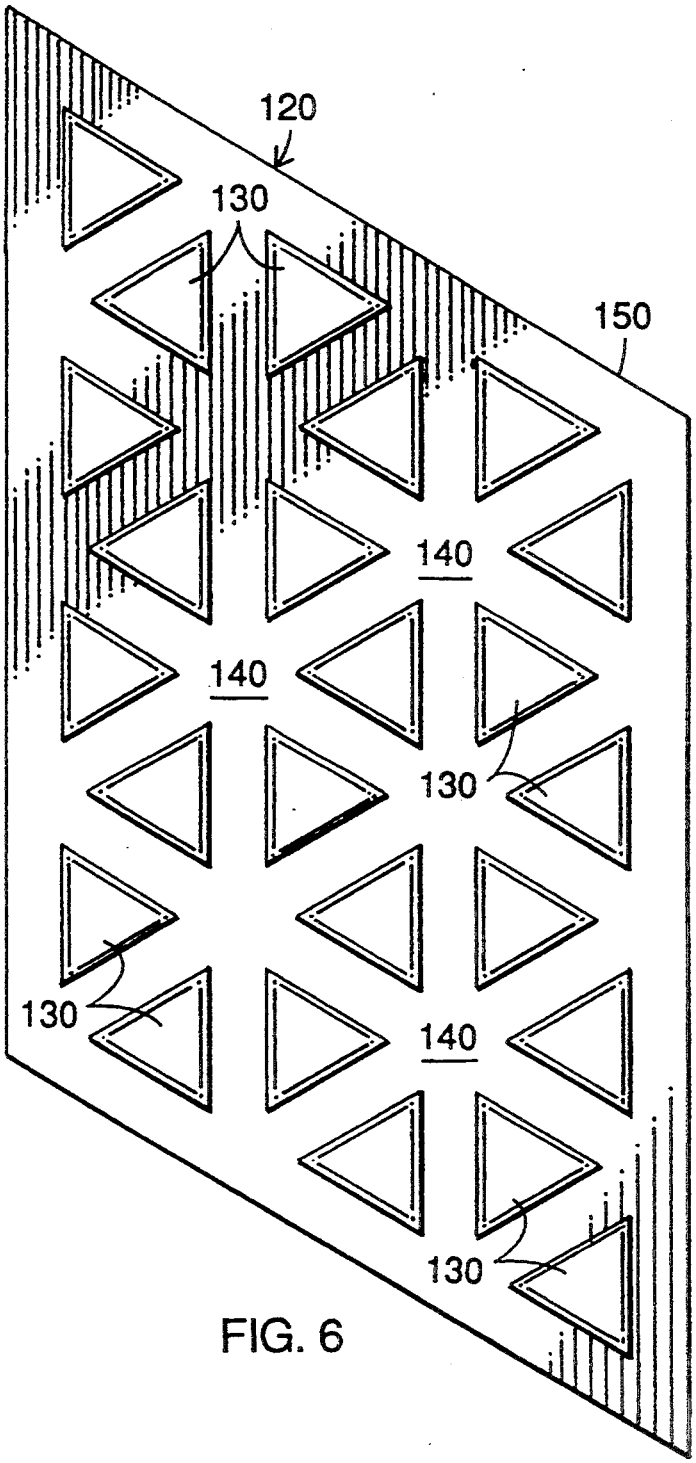

FIG. 6 is a top plan view of an array of tiles for a second preferred embodiment of the present invention in which all of the tiles are equilateral triangles and the array consists of twenty four tiles arranged in three rows of eight triangles each in alternating orientations to define a parallelogram.

Figure 7:
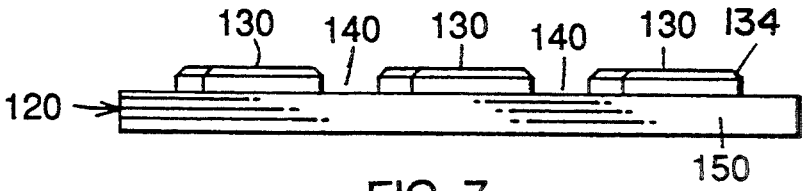

FIG. 7 is a left side elevational view thereof, the right side elevational view being identical.

Figure 8:
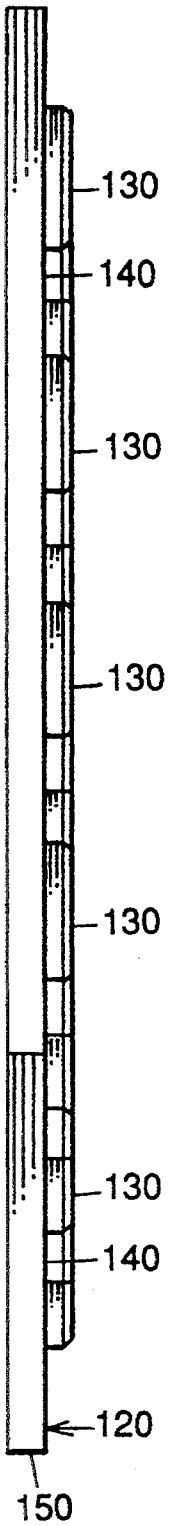

FIG. 8 is a front elevational view thereof, the rear elevational view being a mirror image.

Figure 9:
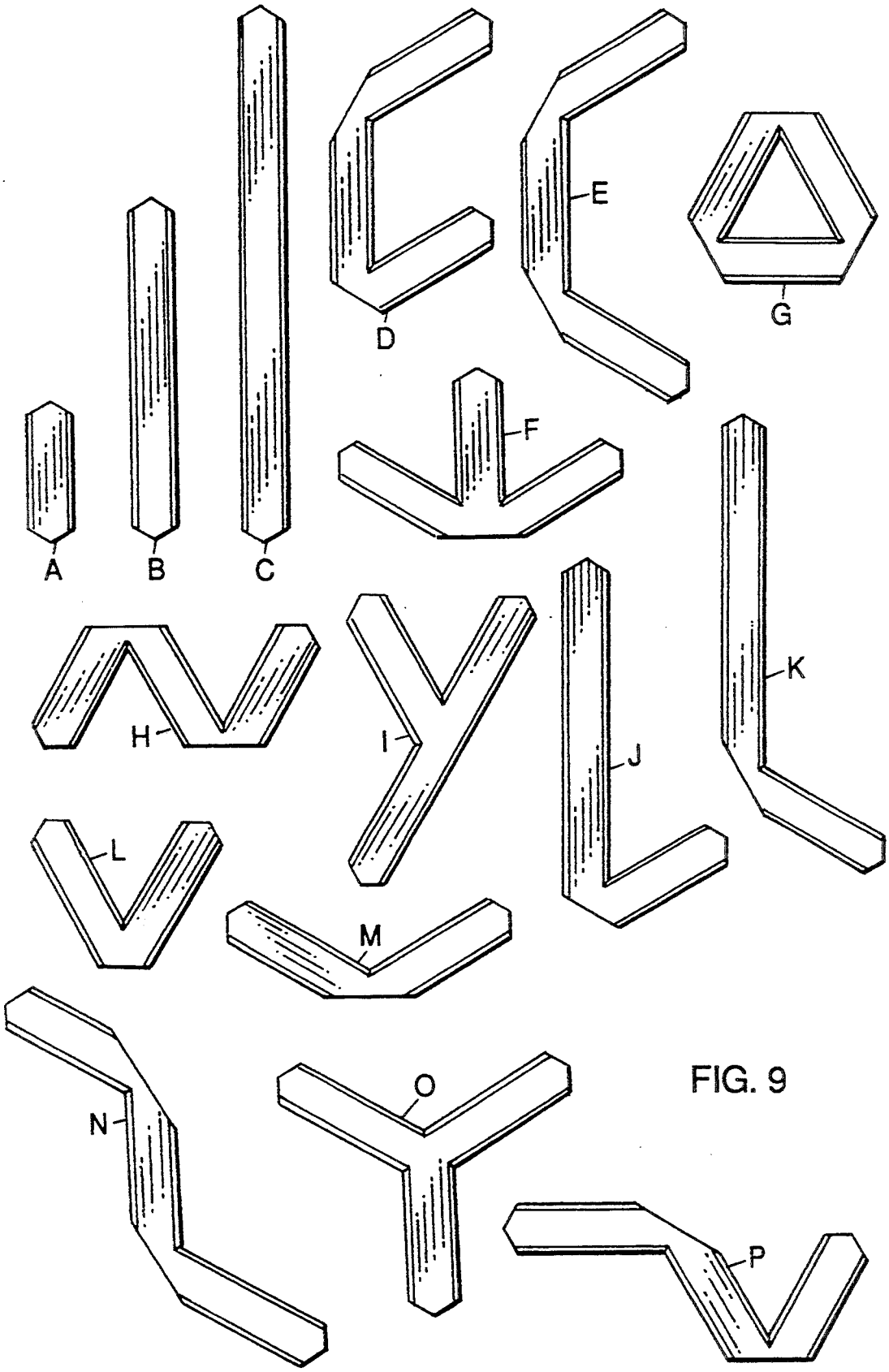

FIG. 9 is a top plan view of a preferred embodiment of grout pieces for use in connection with the array of FIG. 6, which are labeled and named as follows:

(A)—"i"
(B)—"2*i*"
(C)—"3*i*"
(D)—"Narrow C"
(E)—"Wide C"
(F)—"Anchor"
(G)—"Triangle"
(H)—"N"
(I)—"Y"
(J)—"Narrow L"
(K)—"Wide L"
(L)—"Narrow V"
(M)—"Wide V"
(N)—"Z"
(O)—"Propeller"
(P)—"Dipper"

Figure 10:
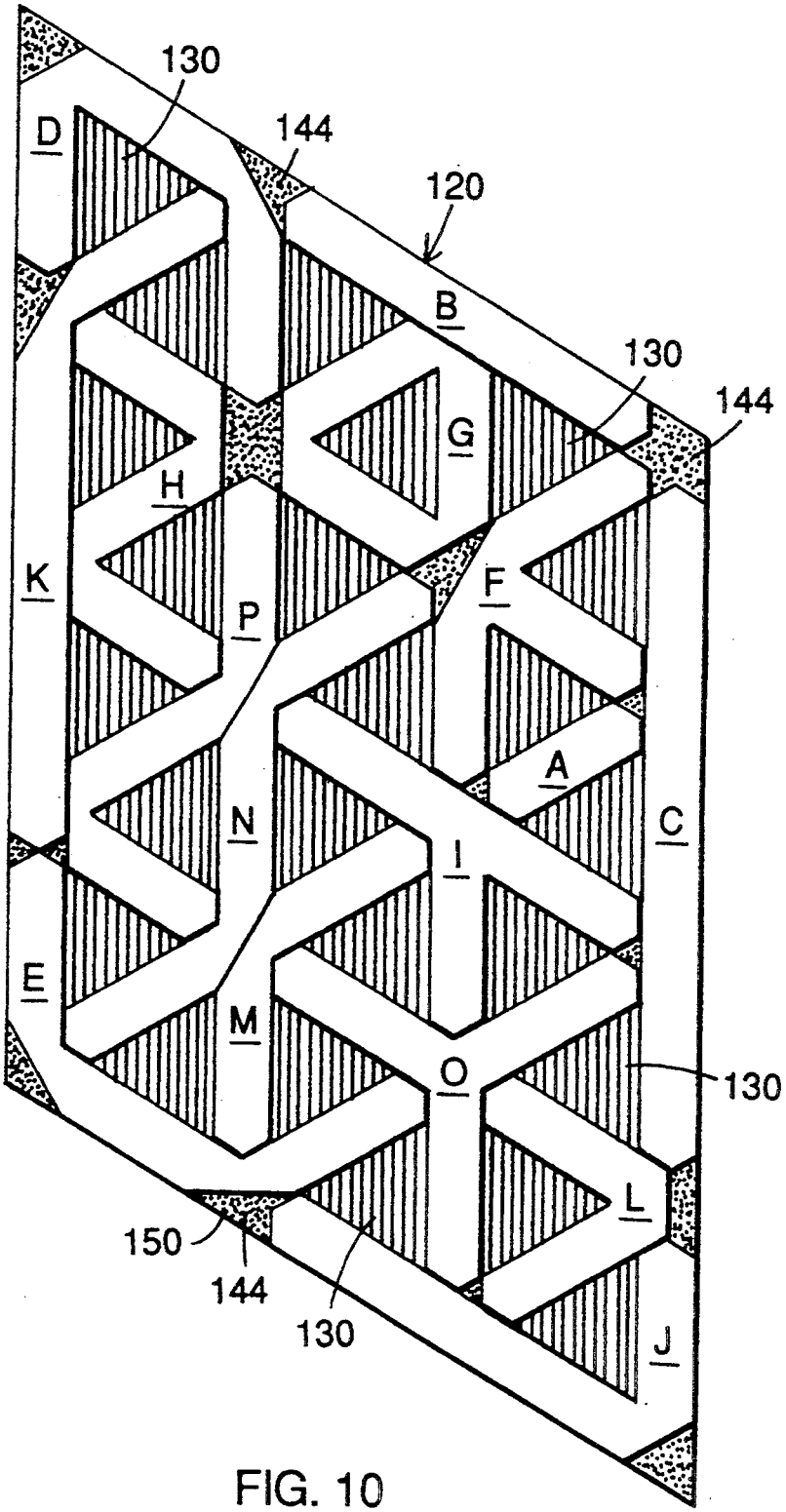

FIG. 10 is a top plan view of an alternative embodiment of an array of tiles according to FIG. 6 illustrating one solution to the puzzle in which each tile consists of a plurality of parallel adjacent elongated pieces, with all of the grout pieces of FIG. 9 received in the web of channels and peripheral channel defined by the tiles, and the corresponding piece numbers from FIG. 9 labeled thereon.

BEST MODES FOR CARRYING OUT INVENTION

FIG. 1 shows an array of tiles in accordance with a first preferred embodiment of the present invention in which all the tiles are a regular equilateral polygon with four sides, namely a square. All the tiles are fixed within a square peripheral channel so that their sides are parallel to and spaced apart from adjacent sides of adjacent tiles by a constant channel width so that the tiles define a web of intersecting channels, the channels all intersecting each other at integer multiples of a constant web angle. In other words, the channels all intersect each other at an integer multiple of the web angle of 90 degrees. Thus, FIG. 1 shows a puzzle 20 comprising an array of 36 square tiles 30 within a square peripheral channel, each of said tiles being positioned so that its sides are parallel to and spaced apart from adjacent sides of adjacent tiles so that the tiles 30 define a web of intersecting channels 40 having a constant channel width within the peripheral channel.

Figure 2:
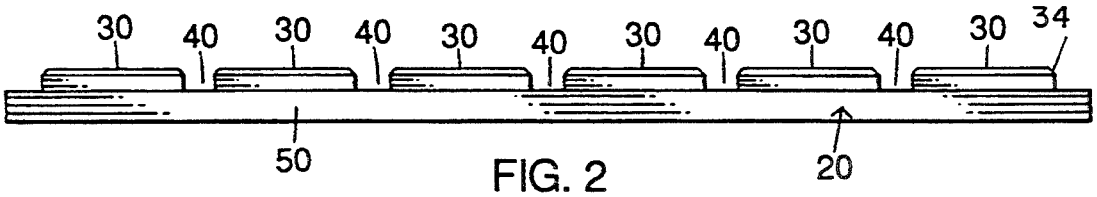
FIG. 2 is a front elevational view of the embodiment of FIG. 1, the rear elevational view and side elevational views being identical.

Referring to FIG. 2, shown is a front plan view of the array of FIG. 1.

Referring to FIGS. 3A and 3B, shown is the preferred set of movable grout pieces, which consists of all possible different configurations of grout pieces containing between one and four contiguous grout segments (each segment having a length equal to the sides of the tiles 30 of FIG. 1 and a width equal to the channel width between the tiles of FIG. 1) with the segments of multi-segment grout pieces joined at their ends having an integer multiple of the web angle between contiguous segments. Further, each of the 24 grout pieces in FIGS. 3A and 3B is different; none is repeated and none is a mirror image of any other. The grout pieces of FIGS. 3A and 3B do not perfectly cover all the channels of the array of FIG. 1 because they must have some physical width in order to be seen and manipulated, and they also must have some width at various intersections of grout segments so that intersecting grout segments can remain joined together. The set of grout pieces of FIGS. 3A and 3B is preferred because of its mathematical elegance: it contains all possible different configurations of grout pieces that contain between one and four segments that can fit (be received by) in some portion of the web.

Referring to FIG. 4, shown is an alternative embodiment of the array of FIG. 1 in which each tile consists of a plurality of parallel adjacent elongated pieces. All of the grout pieces of FIGS. 3A and 3B have been received in (fitted into) the channels 40 to completely cover all of the channels 40 between the tiles 30 and the peripheral channel, leaving only certain voids 44 uncovered. The solution illustrated in FIG. 4 is not a unique solution. If the grout pieces did not have any width, which would be true in the mathematical abstract, then the grout pieces would completely cover all of the channels 40 between the tiles 30 and the peripheral channel. FIG. 4 also shows that it is not necessary that each tile constitute a single piece because each tile consists of a plurality of parallel adjacent elongated pieces. Indeed, the tiles do not have to be consistent in configuration; for example, each tile could have a different representation marked on it, such as a number, flower, animal or other marking, as long as the tiles define the web of intersecting channels. Further, it is even possible to increase the complexity of the puzzle by imposing a further restriction on solutions of the puzzle that requires that some relationship between certain tiles and certain grout pieces be satisfied. For example, the grout pieces could be marked with various "road" or "track" markings and certain of the tiles similarly could be marked with corresponding markings, and the puzzle would only be solved if the markings on the grout pieces align with the corresponding markings on the tiles. For a further example, the puzzle could be made easier by marking the tiles and the grout pieces so that the relationships of grout pieces to tiles can be visually determined, such as by marking the solved puzzle with a picture, so that it can be solved like a jigsaw puzzle.

Because the tiles in the array of FIG. 1 are squares, with a constant interior angle of 90 degrees, and the squares are all positioned so their sides are parallel to the sides of adjacent squares, the array of FIG. 1 is constrained to be a web of channels intersecting at web angles that constitute integer multiples of 90 degrees. The grout pieces of FIGS. 3A and 3B therefore can be described as the set of all possible different configurations of grout pieces containing between one and four grout segments in which the grout segments of the multi-segment grout pieces are joined to each other at web angles constituting all possible integer multiples of the interior angle of 90 degrees.

Although not preferred, the invention also can be practiced with simplified sets of grout pieces that contain less than all the pieces shown in FIGS. 3A and 3B and duplicates or mirror images of various pieces. Also, the invention can be practiced with a set of grout pieces containing pieces in addition to those shown in FIGS. 3A and 3B, such as pieces containing five segments. However, this invention cannot be practiced without a set of grout pieces containing at least one piece containing two grout segments. If all of the grout pieces consisted of only one grout segment, the solution would be so trivial that there would not be a puzzle.

The invention also can be practiced with different numbers of tiles in the array, and this would require appropriate modification of the set of grout pieces.

Referring to FIG. 5, shown is a sectional view of FIG. 4 along the line 5—5 showing how a grout piece can fit in (be received by) channels between adjacent tiles and the peripheral channel.

Preferably, the tiles constitute physical tiles that are mounted on a flat backing material so that they are fixed in positions spaced apart and parallel from each other to define a web of intersecting channels and a peripheral channel. Although materials used are not critical to the invention, it is presently preferred that the tiles 30 and backing material 50 be integrally formed of plastic. It is preferred that each of the tiles 30 be beveled at their top edges 34 so that grout pieces can be more easily introduced into the channels 40 in the web.

This invention also can be practiced with tiles that constitute mere visual representations, such as pictures on paper or, preferably, visual displays. The grout pieces also can constitute either physical pieces of the appropriate shapes shown in FIGS. 3A and 3B (or any other set of grout pieces as described above), or only visual representations, such as visual displays. Visual display embodiments of the present invention can be implemented on, for example, a computer, in which an array of fixed tiles is displayed and a set of movable grout pieces is displayed and can be manipulated by the user in order to attempt to solve the puzzle. It is considered that a person of ordinary skill in the art to which the invention pertains will be able to program a computer to display an array of tiles and movable fixed grout pieces to be fit into the puzzle without undue experimentation. For example, it would be within the skill of a person of ordinary skill in the art to use a computer drawing program to create the array of tiles that forms the web of channels, to create the grout pieces, and to manipulate the grout pieces with respect to the channels using a mouse or other computer input means. Such a computer implementation preferably would include a feature to fill in, or heal, the voids between certain grout pieces.

Referring to FIG. 6, shown is a second preferred embodiment in which the tiles comprise equilateral triangles 130 with sides parallel to and spaced apart from the sides of adjacent tiles and fixed in an array 120 of three rows with eight equilateral triangles having alternating orientations so that the tiles 130 define an array in the shape of a parallelogram and form a web of intersecting channels 140, each of the channels intersecting the other channels at an integer multiple of the web angle of 60 degrees. Preferably the tiles 130 are mounted on backing material 150. Preferably also the tiles 130 are beveled at their top edges 134. FIG. 7 shows a right side view of the array of FIG. 6, the left side view being identical. FIG. 8 shows a front elevational view of the array of FIG. 6, the rear elevation view being identical.

FIG. 9 shows a preferred set of movable grout pieces for use in connection with the array of FIG. 6. Similarly to the set of grout pieces shown in FIGS. 3A and 3B, the grout pieces shown in FIG. 9 consist of the set of all grout pieces containing between one and three segments that can fit in (be received by) a portion of the web of intersecting channels defined by the array of FIG. 6 and the peripheral channel. Again, the tiles in the preferred set are all different; none is repeated, and none is a mirror image of another.

Because tiles in the array of FIG. 9 are equilateral triangles with a constant interior angle of 60 degrees spaced apart from each other with their sides parallel to the sides of adjacent triangles, the array of FIG. 6 is constrained to be a web of channels intersecting at web angles constituting integer multiples of the interior angle of 60 degrees. The grout pieces of FIG. 9 therefore can be defined as the set of all possible different configurations of grout pieces having between one and three contiguous grout segments joined at their ends in which the segments of the multi-segment grout pieces are joined to each other at web angles constituting all possible integer multiples of the interior angle of 60 degrees.

Referring to FIG. 10, shown is an alternative embodiment of the array of FIG. 6, in which each of the tiles consists of a plurality of parallel adjacent elongated pieces. The set of grout pieces of FIG. 9 is received by (fitted into) the intersecting channels defined by the array of FIG. 9 and the peripheral channel, leaving only a few voids 144. The solution illustrated in FIG. 10 is not a unique solution. As in the case of FIG. 4, FIG. 10 shows that the tiles do not have to be of one piece because each tile consists of a plurality of parallel adjacent elongated pieces. The tiles also do not have to be consistent in configuration, as noted above for FIG. 6, as long as the tiles define the web of channels and the peripheral channel.

As with the first preferred embodiment described above, the second preferred embodiment also can be implemented either using physical tiles attached to a backing material so that the tiles are fixed in position parallel to and spaced apart from each other to define a web of intersecting channels, with physical grout pieces. Alternatively, the arrays and grout pieces can be merely visual representations, in which the array of tiles of FIG. 6 would be displayed and visual representations of a set of grout pieces can be manipulated by a user.

As was the case with the first preferred embodiment described above, the set of grout pieces of FIG. 9 is preferred for its mathematical elegance because it consists of the set of all possible different configurations of grout pieces containing between one and three contiguous segments that can fit in the portion of the web and the peripheral channel. Again, however, different sets of grout pieces can be used, and grout pieces can be duplicated or the number of types of grout pieces can be reduced. However, at least one of the set of grout pieces must contain at least two grout pieces because a set of grout pieces containing only single grout segments would be so trivial that to solve it would not constitute a puzzle.

The invention has been described with respect to particular preferred embodiments. However, it will be apparent to those skilled in the art that various alterations and modifications can be made without departing from the spirit and scope of the invention. For example, the tiles in the array can constitute other equilateral polygons, such as hexagons and other polygons that can tile a plane and define a web of channels of a constant channel width. For a further example, the tiles can be combinations of equilateral polygons, such as octagons and squares both having sides of equal length, in which, if the octagons are oriented so that the top and bottom sides are horizontal, the squares are oriented like diamonds in the interstices between adjacent octagons. It is also not necessary that the equilateral polygons be regular polygons. For example, the invention also can be practiced with tiles, each of which constitutes a rhombus. However, if the tiles are not in the shape of a regular polygon, then the channels in the web will not intersect each other at a constant angle and therefore the number of grout pieces necessary to complete the puzzle will be greatly increased because of the need to accommodate substantially more angles between contiguous grout segments. The invention also can be practiced with polygons that are not equilateral, especially if some sides are integer multiples of other sides. However, this would be considered to be equivalent to the case of equilateral polygons. For example, tiles that are twice as long as they are wide are considered to be equivalent to two square tiles with the channel between the tiles removed. It would be performing the same function in substantially the same way to achieve substantially the same result to make a puzzle using grout pieces in an array of such rectangular tiles. Accordingly, no limitation shall be implied or inferred except as specifically and explicitly set forth in the attached claims.

Industrial Applicability

This invention is applicable wherever it is desired to provide a puzzle that is challenging. Moreover, the preferred embodiments of the puzzle illustrate deep mathematical principles and therefore can be used in educational contexts as well.

I claim:

1. A puzzle, comprising:

an array of identical tiles within a periphery, each of said tiles having the shape of an equilateral polygon with a polygon number of sides, with each side of said polygon having an equal polygon length, each of said tiles being fixed so that its sides are parallel to and spaced apart from adjacent sides of adjacent tiles by a constant channel width, whereby said tiles define a web of intersecting channels and a peripheral channel around said array, said peripheral channel having a width equal to said channel width, said channels intersecting each other at integer multiples of a web angle;

a set of movable grout pieces, each of which comprises at least one elongated grout segment, each grout segment having a width approximately equal to said channel width and a length approximately equal to said polygon length, at least one of said grout pieces comprising at least two contiguous grout segments joined to each other at their respective ends at said web angle.

2. A puzzle according to claim 1, wherein said polygon comprises a regular polygon, with a single constant interior angle, and wherein said web angle is equal to said interior angle.

3. A puzzle according to claim 1, wherein said grout pieces comprise all possible configurations of between one and said polygon number of contiguous grout segments, with the segments of multi-segment grout pieces joined only at their ends, wherein contiguous grout segments are joined at integer multiples of said web angle, whereby said grout pieces will each fit in a portion of the web of channels and peripheral channel.

4. A puzzle according to claim 3, wherein all of said grout pieces are different.

5. A puzzle according to claim 2, wherein said polygon number is three and said polygons comprise equilateral triangles.

6. A puzzle according to claim 2, wherein said polygon number is four and said polygons comprise squares.

7. A puzzle according to claim 1, wherein said tiles and said grout pieces comprise plastic.

8. A puzzle according to claim 1, wherein said tiles are integrally formed with a backing.

9. A puzzle according to claim 1, wherein said tiles and said grout pieces comprise purely visual representations.

10. A puzzle according to claim 9, wherein said visual representations are generated by a computer program.

11. A puzzle according to claim 1, wherein said periphery has the shape of one of said tiles.

12. A puzzle, comprising:

an array of identical tiles within a periphery, each of said tiles having the shape of a square with four sides, with each of said sides being an equal side length, each of said tiles being fixed so that its sides are parallel to and spaced apart from adjacent sides of adjacent tiles by a constant channel width, whereby said tiles define a web of intersecting channels and a peripheral channel around said array, said peripheral channel having a width equal to said channel width and said channels intersecting each other at integer multiples of 90 degrees;

a set of movable grout pieces, each of which comprises at least one elongated grout segment, each grout segment having a width approximately equal to said channel width and a length approximately equal to said side length, at least one of said grout pieces comprising at least two contiguous grout segments joined at their ends at 90 degrees.

13. A puzzle according to claim 12, wherein said periphery is square in shape.

14. A puzzle according to claim 12, wherein said grout pieces comprise all possible different configurations of between one and four contiguous grout segments, with segments of multi-segment grout pieces joined only at their ends at all possible integer multiples of 90 degrees, whereby said grout pieces will all fit in said web of channels and said peripheral channel.

15. A puzzle according to claim 14, wherein said array comprises an array of six tiles by six tiles and said periphery is square.

16. A puzzle, comprising:

an array of identical tiles in a periphery, each of said tiles having the shape of an equilateral triangle with three sides, each of said sides being an equal side length, each of said tiles being fixed so that its sides are parallel to and spaced apart from adjacent sides of adjacent tiles by a constant channel width, whereby said tiles define a web of intersecting channels and a peripheral channel around said array, said peripheral channel having a width equal to said channel width, said channels intersecting each other at integer multiples of 60 degrees;

a set of movable grout pieces, each of which comprises at least one elongated grout segment, each grout segment having a width approximately equal to said channel width and a length approximately equal to said side length, at least one of said grout pieces comprising at least two contiguous grout segments joined at their ends at 60 degrees.

17. A puzzle according to claim 16, wherein said grout pieces comprise all possible different configurations of between one and three contiguous grout segments, with segments of the multi-segment grout pieces joined only at their ends at all possible integer multiples of 60 degrees, and wherein all of said grout pieces will fit in said web of channels and said peripheral channel.

18. A puzzle according to claim 17, wherein said array comprises an array of three rows of eight tiles each, said tiles having alternating orientations, and said periphery is in the shape of a parallelogram.

* * * * *